US009376865B2

(12) United States Patent
Kirkhope et al.

(10) Patent No.: US 9,376,865 B2
(45) Date of Patent: Jun. 28, 2016

(54) ROTATIONAL LOCKING MECHANISMS FOR DRILLING MOTORS AND POWERTRAINS

(71) Applicant: Halliburton Energy Services Inc., Houston, TX (US)

(72) Inventors: Kennedy J. Kirkhope, Leduc (CA); Alben D'Silva, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 484 days.

(21) Appl. No.: 13/826,741

(22) Filed: Mar. 14, 2013

(65) Prior Publication Data

US 2013/0313022 A1 Nov. 28, 2013

Related U.S. Application Data

(60) Provisional application No. 61/651,710, filed on May 25, 2012.

(51) Int. Cl.
*E21B 4/02* (2006.01)
*E21B 23/00* (2006.01)

(52) U.S. Cl.
CPC .. *E21B 4/02* (2013.01); *E21B 23/00* (2013.01)

(58) Field of Classification Search
USPC ..... 175/92, 101, 107
See application file for complete search history.

(56) References Cited

U.S. PATENT DOCUMENTS

| | | | | |
|---|---|---|---|---|
| 4,232,751 | A | 11/1980 | Trzeciak | |
| 4,253,532 | A | 3/1981 | Geczy | |
| 4,276,944 | A | 7/1981 | Geczy | |
| 4,295,535 | A | 10/1981 | Crase et al. | |
| 4,299,296 | A | 11/1981 | Geczy | |
| 4,386,666 | A | 6/1983 | Crase et al. | |
| 4,632,193 | A | 12/1986 | Geczy | |
| 7,036,580 | B2 | 5/2006 | McGarian et al. | |
| 7,377,337 | B2 | 5/2008 | Swietlik et al. | |
| 7,413,034 | B2 | 8/2008 | Kirkhope et al. | |
| 7,703,550 | B2 | 4/2010 | Nevlud et al. | |
| 7,735,581 | B2 | 6/2010 | Beylotte et al. | |
| 2008/0264692 | A1 * | 10/2008 | Underwood | E21B 4/02 175/106 |
| 2010/0314172 | A1 | 12/2010 | Underwood et al. | |

FOREIGN PATENT DOCUMENTS

| | | | |
|---|---|---|---|
| WO | WO/2010/030272 A1 | | 3/2010 |
| WO | WO 2010/098755 | * | 9/2010 |

* cited by examiner

*Primary Examiner* — Sean Andrish
(74) *Attorney, Agent, or Firm* — Chamberlian, Hrdlicka

(57) ABSTRACT

Rotational locking mechanisms for drill string assemblies, bottom hole assemblies, and drilling motors are presented herein. A fluid-driven motor assembly is disclosed for use in a drill string to drill a borehole in an earth formation. The drill string includes a drill pipe and a drill bit. The motor assembly includes a housing that is configured to operatively connect to the drill pipe of the drill string to receive drilling fluid therefrom. A stator, which is disposed within the housing, is configured to rotate at a stator speed. A rotor is disposed within the stator and coupled to the drill bit. The rotor is configured to rotate at a rotor speed. The motor assembly also includes a rotational locking assembly operatively coupled to the rotor and the housing. The rotational locking assembly is configured to prevent the stator speed of the stator from exceeding the rotor speed of the rotor.

19 Claims, 5 Drawing Sheets

ROTATIONAL LOCKING MECHANISMS FOR DRILLING MOTORS AND POWERTRAINS

CLAIM OF PRIORITY AND CROSS-REFERENCE TO RELATED APPLICATION

This application claims the benefit of and priority to U.S. Provisional Patent Application No. 61/651,710, which was filed on May 25, 2012, and is incorporated herein by reference in its entirety.

TECHNICAL FIELD

The present disclosure relates generally to the drilling of boreholes, for example, during hydrocarbon exploration and excavation. More particularly, the present disclosure relates to drilling assemblies and powertrains with fluid-driven motors used in drilling boreholes.

BACKGROUND

Boreholes, which are also commonly referred to as "wellbores" and "drill holes," are created for a variety of purposes, including exploratory drilling for locating underground deposits of different natural resources, mining operations for extracting such deposits, and construction projects for installing underground utilities. A common misconception is that all boreholes are vertically aligned with the drilling rig; however, many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Conventional directional boring techniques traditionally operate from a boring device that pushes or steers a series of connected drill pipes with a directable drill bit at the distal end thereof to achieve the borehole geometry. In the exploration and recovery of subsurface hydrocarbon deposits, such as petroleum and natural gas, the directional borehole is typically drilled with a rotatable drill bit that is attached to a working end of a bottom hole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often comprising jointed pipe or relatively flexible "spoolable" tubing, also known as "coiled tubing." This directional drilling system—i.e., the operatively interconnected tubing, drill bit, and BHA—is usually referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Many conventional drilling motors include a progressive cavity, positive displacement motor (PDM) to provide additional power to the bit during a drilling operation. As an alternative to PDMs, some BHAs will employ a turbine-based motor (or "turbodrill") to provide the additional power. Both PDM and turbine motors are fluidly driven by the drilling mud pumped down the drill string, through the drilling motor, and out the bit assembly. For example, a typical PDM assembly (also known as a "Moineau motor") includes a multi-lobed stator with an internal passage within which is disposed a multi-lobed rotor. The PDM assembly operates according to the Moineau principle, where pressurized fluid that is forced through the series of helically shaped channels formed between the stator and rotor acts against the rotor causing nutation and rotation of the rotor within the stator. Rotation of the rotor generates a rotational drive force for the drill bit. Additional information regarding positive displacement mud motors can be found in commonly owned U.S. patent application Ser. No. 12/876,515, which was filed on Sep. 7, 2010, and is incorporated herein by reference in its entirety and for all purposes.

During a borehole drilling operation, the drill bit may become lodged in the earth formation or stuck in debris that has accumulated in the borehole around the BHA. Under such circumstances, it can be difficult, if not impossible, to pull the entire drill string, including the drill bit and BHA, out of the borehole. In arrangements where the drill bit is attached to the lower end of a drill pipe arrangement, the drill pipe can be rotated by the rotary table as an upward (pulling) force is applied to the drill string in an attempt to dislodge the stuck drill bit. In the event that the drill bit cannot be dislodged through rotation of the drill pipe, the drill bit or, in some arrangements, the entire BHA assembly may be separated from the remainder of the drill string (e.g., via a release joint). After the drill string is pulled uphole and removed from the borehole, the abandoned drill bit/BHA can then be "fished" from the earth formation. This process, however, is very time consuming and expensive.

In drill strings with an in-hole motor, such as fluid-driven mud motors, wherein the drill bit is driven, at least in part, by a mud motor interposed between the string of drill pipes and the bit, it is oftentimes not possible to dislodge the stuck drill bit by causing the bit to rotate by rotation of the drill pipe string above the motor. This is so because the reaction torque of such in-hole motors is, generally speaking, taken by a rotary table at the surface of the borehole, whereby the drill pipe string can either be held stationary or, if desired, rotated to obviate the wedging of the string. If the bit becomes stuck, the motor will oftentimes stall such that continued rotation of the bit may not be possible, notwithstanding the availability of additional fluid pressure or, in the case of electrically driven in-hole motors, electromotive force. As a consequence, freeing the drill string often requires the drill pipe string and motor be jarred and pulled from the borehole without rotating the bit.

SUMMARY

Aspects of the present disclosure are directed to a fluid-driven motor assembly for use in a drill string to drill a borehole in an earth formation. The drill string includes a drill pipe and a drill bit. The motor assembly includes a housing that is configured to operatively connect or otherwise couple to the drill pipe of the drill string to receive drilling fluid therefrom. A stator, which is disposed within the housing, is configured to rotate at a stator speed. A rotor, which is disposed within an internal passage of the stator and coupled to the drill bit, is configured to rotate at a rotor speed. The motor assembly also includes a rotational locking assembly operatively coupled to the rotor and the housing. The rotational locking assembly is configured to prevent the stator speed of the stator from exceeding the rotor speed of the rotor.

In some embodiments, the rotational locking assembly includes a swash-plate actuated friction brake assembly configured to selectively lock the rotor to the housing. In some embodiments, the rotational locking assembly includes a differential-pressure lockup assembly configured to selectively lock the rotor to the housing in response to a threshold difference in fluid pressure across the differential-pressure lockup assembly. In some embodiments, the rotational locking assembly includes a one-way overrunning coupler assembly configured to lock the rotor to the housing when the stator speed of the stator exceeds the rotor speed of the rotor. In at least some embodiments, the rotational locking assembly protects the internal power train from torque spike due to motor stall, and can be used to free a stuck bit by transmitting the torque from top drive (TD).

According to other aspects of the present disclosure, a drilling motor assembly is disclosed for use in a drill string to drill a borehole in an earth formation. The drill string includes a drill pipe and a drill bit. The drilling motor assembly includes a motor housing configured to mechanically couple to the drill pipe in the drill string such that the drill pipe transmits rotational drive forces to the motor housing. A prime mover is disposed within the motor housing. A drive shaft is configured to transmit rotational drive forces generated by the prime mover to the drill bit. The drilling motor assembly also includes a rotational locking assembly operatively coupled to the drive shaft and the housing. The rotational locking assembly is configured to selectively lock the drive shaft to the motor housing such that torsional forces can be transferred back from the drill bit through the drives shaft and the rotational locking assembly to the motor housing. The prime mover can be a positive displacement motor, a turbine motor, an electric motor, another in-hole motor assembly, or any combination thereof.

In accordance with other aspects of the present disclosure, a drill string assembly is featured. The drill string assembly includes a drill-pipe string and a motor housing mechanically and fluidly coupled to a distal end of the drill-pipe string such that the drill-pipe string transmits rotational drive forces and drilling fluid to the motor housing. A drill bit projects from a distal end of the motor housing. A fluid-driven motor assembly is at least partially disposed within the motor housing. The fluid-driven motor assembly includes a rotor that is rotatable within a stator and coupled to the drill bit. The stator is rotated at a stator speed, at least in part, via the rotational drive forces from the drill-pipe string, and the rotor is rotated at a rotor speed, at least in part, via the passing of drilling fluid through the fluid-driven motor assembly. The drill string assembly also includes a rotational locking assembly that is operatively coupled to the rotor and the motor housing. The rotational locking assembly is configured to lock the rotor to the motor housing and thereby prevent the stator speed of the stator from exceeding the rotor speed of the rotor.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure will be readily apparent from the following detailed description of the exemplary embodiments and modes for carrying out the present invention when taken in connection with the accompanying drawings and the appended claims.

Figure 1:
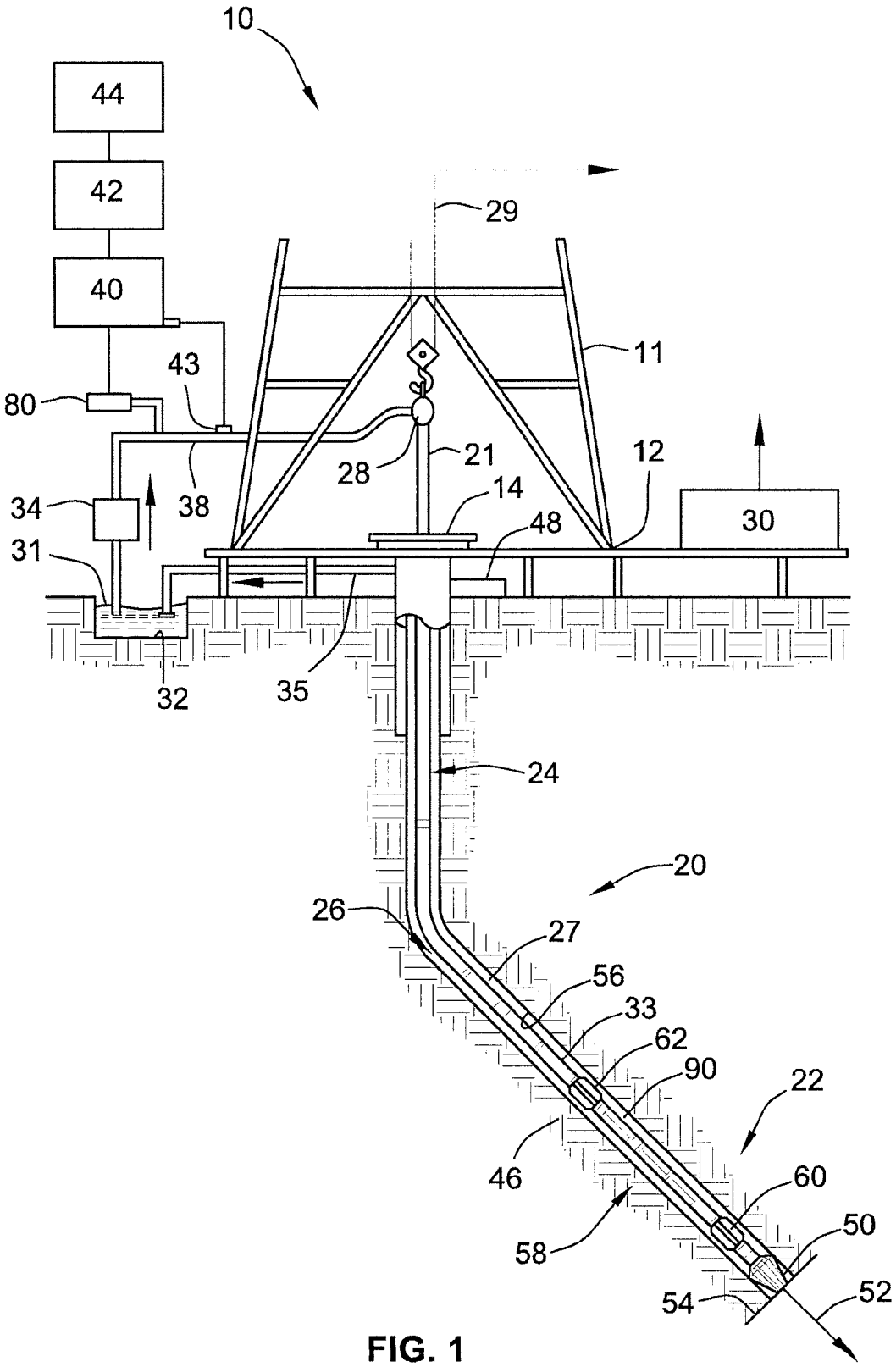
FIG. 1 is a schematic illustration of an exemplary drilling system in accordance with aspects of the present disclosure.

While the present disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION OF THE ILLUSTRATED EMBODIMENTS

This invention is susceptible of embodiment in many different forms. There are shown in the drawings and will herein be described in detail embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed, the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like components throughout the several views, FIG. 1 illustrates an exemplary directional drilling system, designated generally as 10, in accordance with aspects of the present disclosure. Many of the disclosed concepts are discussed with reference to drilling operations for the exploration and/or recovery of subsurface hydrocarbon deposits, such as petroleum and natural gas. However, the disclosed concepts are not so limited, and can be applied to other drilling operations. To that end, the aspects of the present disclosure are not necessarily limited to the arrangement and components presented in FIGS. 1 and 2. For example, many of the features and aspects presented herein can be applied in horizontal drilling applications and vertical drilling applications without departing from the intended scope and spirit of the present disclosure. In addition, it should be understood that the drawings are not necessarily to scale and are provided purely for descriptive purposes; thus, the individual and relative dimensions and orientations presented in the drawings are not to be considered limiting. Additional information relating to directional drilling systems can be found, for example, in U.S. Patent Application Publication No. 2010/0259415 A1, to Michael Strachan et al., which is entitled "Method and System for Predicting Performance of a Drilling System Having Multiple Cutting Structures" and is incorporated herein by reference in its entirety and for all purposes.

The directional drilling system 10 exemplified in FIG. 1 includes a tower or "derrick" 11, as it is most commonly referred to in the art, that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional borehole 26. As illustrated in the Figures, the borehole 26 may travel along a multi-dimensional path or "trajectory." The three-dimensional direction of the bottom 54 of the borehole 26 of FIG. 1 is represented by a pointing vector 52.

A drill bit 50 is attached to the distal, downhole end of the drill string 20. When rotated, e.g., via the rotary table 14, the drill bit 50 operates to break up and generally disintegrate the geological formation 46. The drill string 20, as shown in FIG. 1, is coupled to a "drawworks" hoisting apparatus 30, for example, via a kelly joint 21, swivel 28, and line 29 through a pulley system (not shown). The drawworks 30 may comprise various components, including a drum, one or more motors, a reduction gear, a main brake, and an auxiliary brake. During a drilling operation, the drawworks 30 can be operated, in some embodiments, to control the weight on bit 50 and the rate of penetration of the drill string 20 into the borehole 26. The operation of drawworks 30 is generally known and is thus not described in detail herein.

During drilling operations, a suitable drilling fluid 31 (commonly referred to in the art as "mud") can be circulated, under pressure, out from a mud pit 32 and into the borehole 26 through the drill string 20 by a hydraulic "mud pump" 34. The drilling fluid 31 may comprise, for example, water-based muds (WBM), which typically comprise a water-and-clay based composition, oil-based muds (OBM), where the base fluid is a petroleum product, such as diesel fuel, synthetic-based muds (SBM), where the base fluid is a synthetic oil, as well as gaseous drilling fluids. Drilling fluid 31 passes from the mud pump 34 into the drill string 20 via a fluid conduit (commonly referred to as a "mud line") 38 and the kelly joint 21. Drilling fluid 31 is discharged at the borehole bottom 54 through one or more openings or nozzles in the drill bit 50, and circulates in an "uphole" direction towards the surface through an annular space 27 between the drill string 20 and the periphery of the borehole 26. As the drilling fluid 31 approaches the rotary table 14, it is discharged via a return line 35 back into the mud pit 32. A variety of surface sensors 48, which are appropriately deployed on the surface of the borehole 26, operate alone or in conjunction with downhole sensors 70, 72 deployed within the borehole 26, to provide information about various drilling-related parameters, such as fluid flow rate, weight on bit, hook load, etc.

A surface control unit 40 may receive signals from surface and downhole sensors and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal end of a steerable drilling bottom hole assembly (BHA) 22. In the illustrated embodiment, the BHA 22 is coupled between the drill bit 50 and the drill pipe section 24 of the drill string 20. The BHA 22 may comprise a Measurement While Drilling (MWD) System, designated generally at 58 in FIG. 1, with various sensors to provide information about the formation 46 and downhole drilling parameters. The MWD sensors in the BHA 22 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The MWD 58 may also include additional/alternative sensing devices for measuring shock, vibration, torque, telemetry, etc. The above-noted devices may transmit data to a downhole transmitter 33, which in turn transmits the data uphole to the surface control unit 40. In some embodiments, the BHA 22 may also include a Logging While Drilling (LWD) System.

In some embodiments, a mud pulse telemetry technique may be used to communicate data from downhole sensors and devices during drilling operations. Exemplary methods and apparatuses for mud pulse telemetry are described in U.S. Pat. No. 7,106,210 B2, to Christopher A. Golla et al., which is incorporated herein by reference in its entirety. Other known methods of telemetry which may be used without departing from the intended scope of this disclosure include electromagnetic telemetry, acoustic telemetry, and wired drill pipe telemetry, among others.

A transducer 43 can be placed in the mud supply line 38 to detect the mud pulses responsive to the data transmitted by the downhole transmitter 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. As illustrated in FIG. 1, a surface transmitter receiver 80 communicates with downhole tools using, for example, any of the transmission techniques described, such as a mud pulse telemetry technique. This can enable two-way communication between the surface control unit 40 and the downhole tools described below.

According to aspects of this disclosure, the BHA 22 can provide some or all of the requisite force for the bit 50 to break through the formation 46 (known as "weight on bit"), and provide the necessary directional control for drilling the borehole 26. In the embodiments illustrated in FIGS. 1 and 2, the BHA 22 may comprise a drilling motor 90 and first and second longitudinally spaced stabilizers 60 and 62. At least one of the stabilizers 60, 62 may be an adjustable stabilizer that is operable to assist in controlling the direction of the borehole 26. Optional radially adjustable stabilizers may be used in the BHA 22 of the steerable directional drilling system 10 to adjust the angle of the BHA 22 with respect to the axis of the borehole 26. A radially adjustable stabilizer provides a wider range of directional adjustability than is available with a conventional fixed diameter stabilizer. This adjustability may save substantial rig time by allowing the BHA 22 to be adjusted downhole instead of tripping out for changes. However, even a radially adjustable stabilizer provides only a limited range of directional adjustments. Additional information regarding adjustable stabilizers and their use in directional drilling systems can be found in U.S. Patent Application Publication No. 2011/0031023 A1, to Clive D. Menezes et al., which is entitled "Borehole Drilling Apparatus, Systems, and Methods" and is incorporated herein by reference in its entirety.

Figure 2:
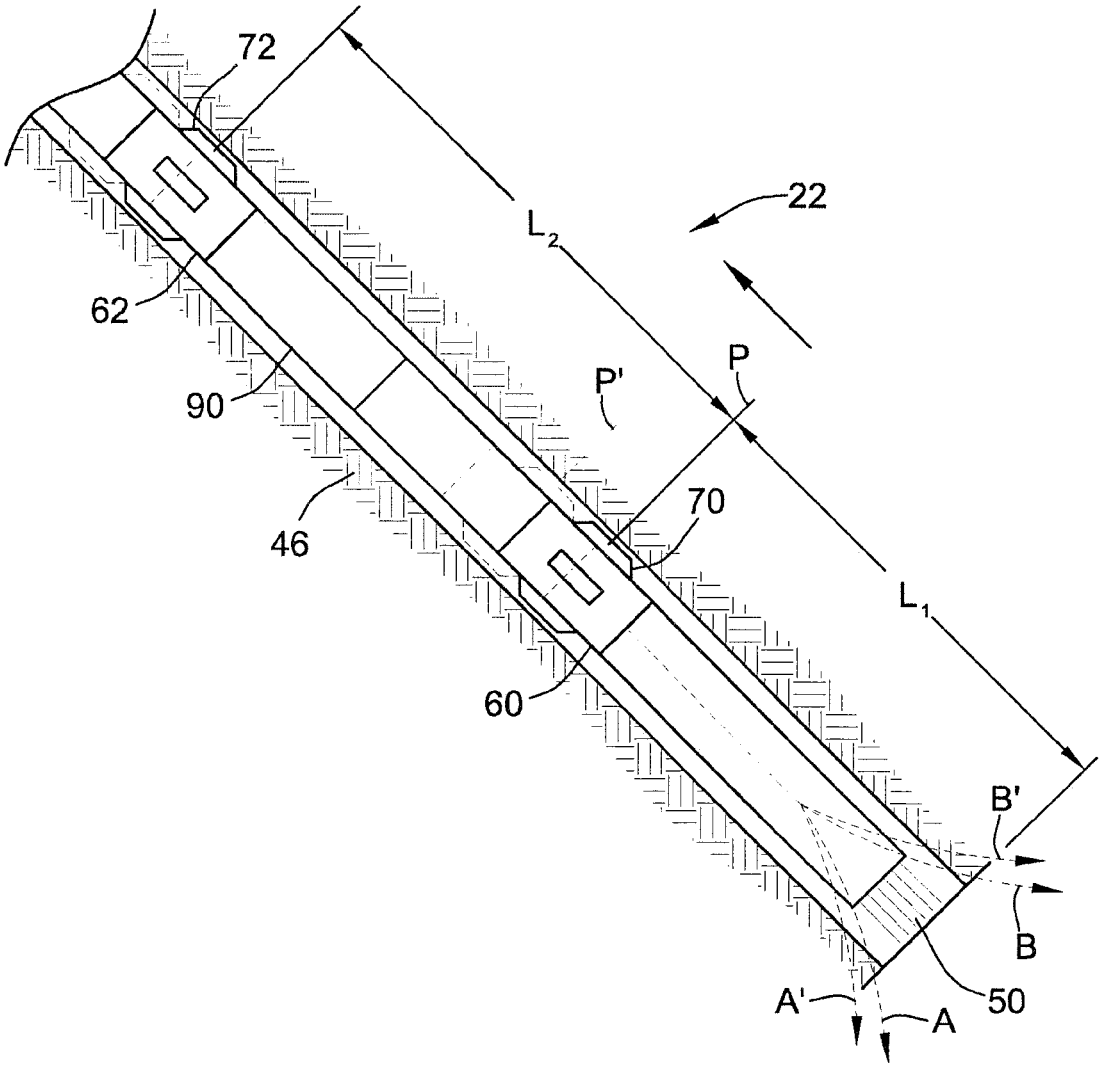
FIG. 2 is a schematic illustration of an exemplary bottom hole assembly (BHA) in accordance with aspects of the present disclosure.

As shown in the embodiment of FIG. 2, the distance between the drill bit 50 and the first stabilizer 60, designated as L1, can be a factor in determining the bend characteristics of the BHA 22. Similarly, the distance between the first stabilizer 60 and the second stabilizer 62, designated as L2, can be another factor in determining the bend characteristics of the BHA 22. The deflection at the drill bit 50 of the BHA 22 is a nonlinear function of the distance L1, such that relatively small changes in L1 may significantly alter the bending characteristics of the BHA 22. With radially movable stabilizer blades, a dropping or building angle, for example A or B, can be induced at bit 50 with the stabilizer at position P. By axially moving stabilizer 60 from P to P', the deflection at bit 50 can be increased from A to A' or B to B'. A stabilizer having both axial and radial adjustment may substantially extend the range of directional adjustment, thereby saving the time necessary to change out the BHA 22 to a different configuration. In some embodiments the stabilizer may be axially movable. The position and adjustment of the second stabilizer 62 adds additional flexibility in adjusting the BHA 22 to achieve the desired bend of the BHA 22 to achieve the desired borehole curvature and direction. As such, the second stabilizer 62 may have the same functionality as the first stabilizer 60. While shown in two dimensions, proper adjustment of stabilizer blades may also provide three dimensional turning of BHA 22.

Figure 3:
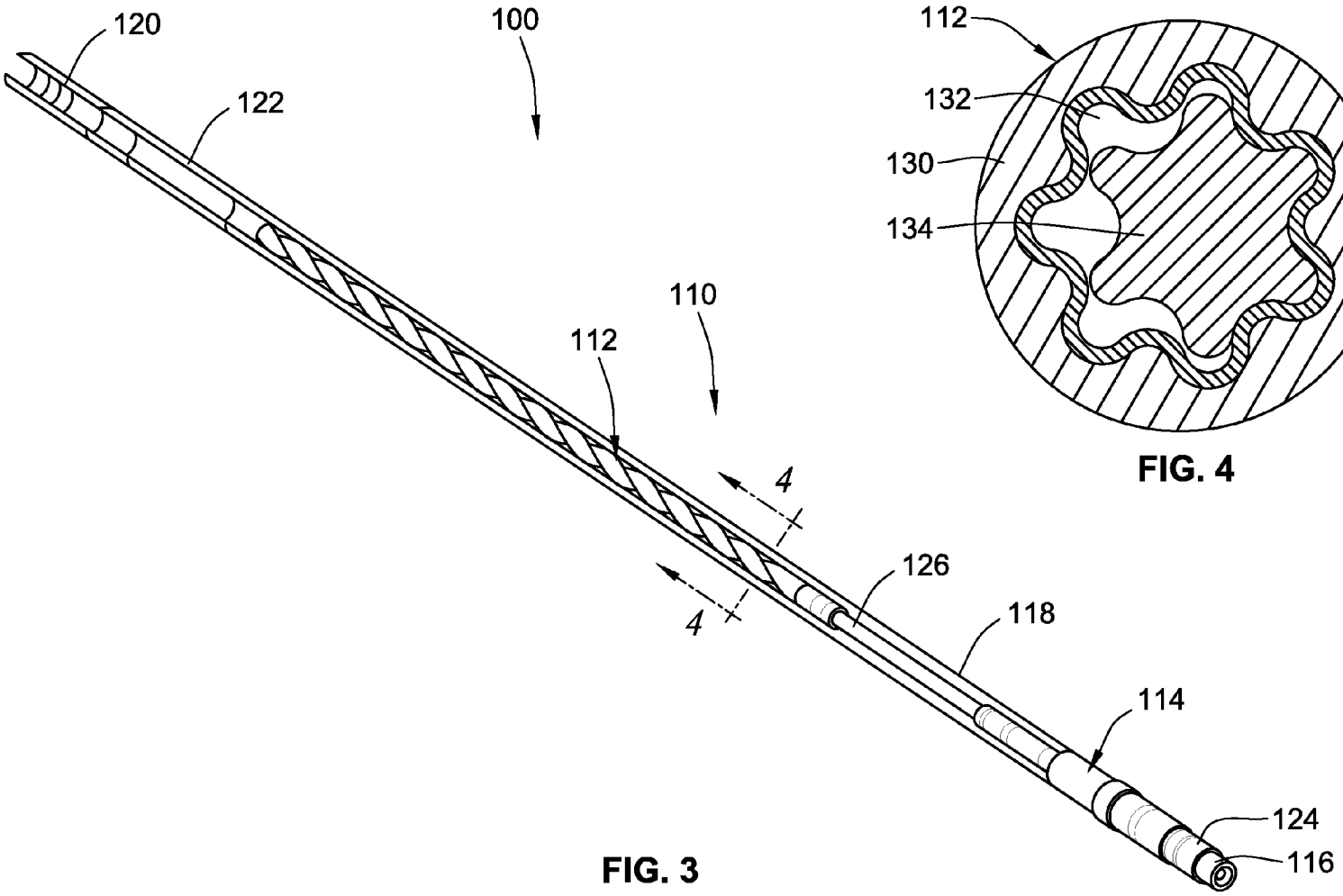
FIG. 3 is a perspective-view illustration of an example of a drill string system with a BHA having a fluid-driven motor and bearing pack assembly in accordance with aspects of the present disclosure.

FIG. 3 illustrates a portion of a drill string system 100 of the type used for drilling a borehole in an earth formation. The drill string system 100 of FIG. 3 is represented by a bottom hole assembly (BHA) 110, which is shown partially broken away to more clearly depict power and transmission sections including, for example, an internally packaged mud motor assembly 112 and bearing pack 114. The drill string system 100 of FIG. 3 can take on any of the various forms, optional configurations, and functional alternatives described above with respect to the directional drilling system 10 exemplified in FIGS. 1 and 2, and thus can include any of the corresponding options and features. Moreover, only selected components of the drill string system 100 have been shown and will be described in additional detail hereinbelow. Nevertheless, the drill string systems discussed below, including the corresponding BHA and powertrain, can include numerous additional, alternative, and other well-known peripheral components without departing from the scope and spirit of the present disclosure. Seeing as these components are well known in the art, they will not be described in further detail.

In the exemplary configuration of FIG. 3, a rotatable drill bit 116 is located at a distal end of the drill string 100, projecting from an elongated, tubular housing 118. The tubular housing 118 is operatively attached or otherwise coupled, e.g., via a top sub 122, to the distal end of a drill pipe or drill-pipe string 120 (e.g., which could be a portion of the drill pipe section 24 of FIG. 1) such that the drill-pipe string 120 transmits rotational drive forces and drilling fluid ("mud") to the tubular housing 118. The bearing pack 114 protects the drill string 110 from off-bottom and on-bottom pressures. The bearing pack 114 may be oil lubricated and sealed. A bottom sub 124 couples a drive shaft 126 of the mud motor assembly 112 to the bit 116. By using a Measurement While Drilling (MWD) Tool, such as MWD 58 of FIG. 1, a directional driller can steer the bit 116 to a desired target zone.

Figure 4:
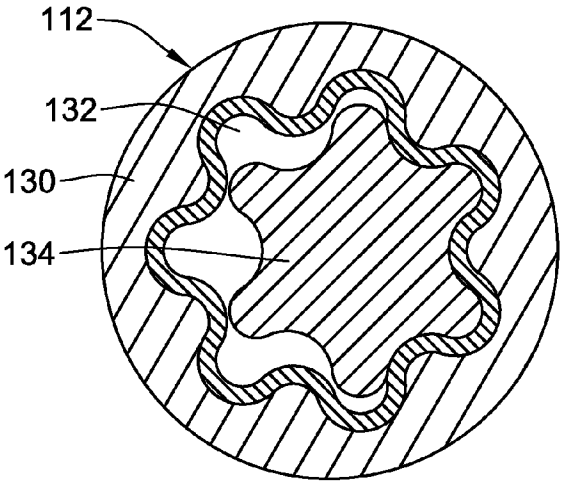
FIG. 4 is a front-view cross-sectional illustration of a portion (e.g., the even wall power section) of the fluid-driven motor of FIG. 3 taken along line 4-4.

In the illustrated embodiment, the fluid-driven motor assembly 112 is a positive displacement motor (PDM) assembly, which may be in the nature of SperryDrill® or SperryDrill® XL/XLS series positive displacement motor assemblies available from Halliburton of Houston, Tex. In this instance, the housing 118 may be considered a portion of a motor housing which is attached to the top sub via the power section. As seen in FIG. 4, the PDM assembly 112 includes a multi-lobed stator 130 with an internal passage 132 within which is disposed a multi-lobed rotor 134. The PDM assembly 112 operates according to the Moineau principle—essentially, when pressurized fluid (e.g., drilling mud from the drill-pipe string 120) is forced into the PDM assembly 112 and through the series of helically shaped channels formed between the stator 130 and rotor 134, the pressurized fluid acts against the rotor 134 causing nutation and rotation of the rotor 134 within the stator 130. Rotation of the rotor 134 generates a rotational drive force for the drill bit 116, such forces being transmitted via the drive shaft 126. In alternative embodiments, the drill string system 100 may further include, or the PDM assembly 112 may be replaced by, a turbine motor and/or an electric motor without departing from the intended scope and spirit of the present disclosure. As used herein, a "drilling motor" or "motor assembly" may therefore refer to any downhole motor used in a well bore for drilling through a formation unless explicitly delimited to a particular type.

The distal end of the rotor 134 is coupled to the rotatable drill bit 116 via the drive shaft 126 such that the eccentric power from the rotor 134 is transmitted as concentric power to the bit 116. In this manner, the PDM assembly 112 can provide a drive mechanism for the drill bit 116 which is at least partially and, in some instances, completely independent of any rotational motion of the drill string generated, for example, via rotation of a top drive in the derrick mast and/or the rotary table 14 on the derrick floor 12 of FIG. 1. Directional drilling may also be performed by rotating the drill string 100 while contemporaneously powering the PDM assembly 112, thereby increasing the available torque and drill bit speed. The drill bit may take on various forms, including diamond-impregnated bits and specialized polycrystalline-diamond-compact (PDC) bit designs, such as the FX and FS Series™ drill bits available from Halliburton of Houston, Tex., for example.

Figure 5:
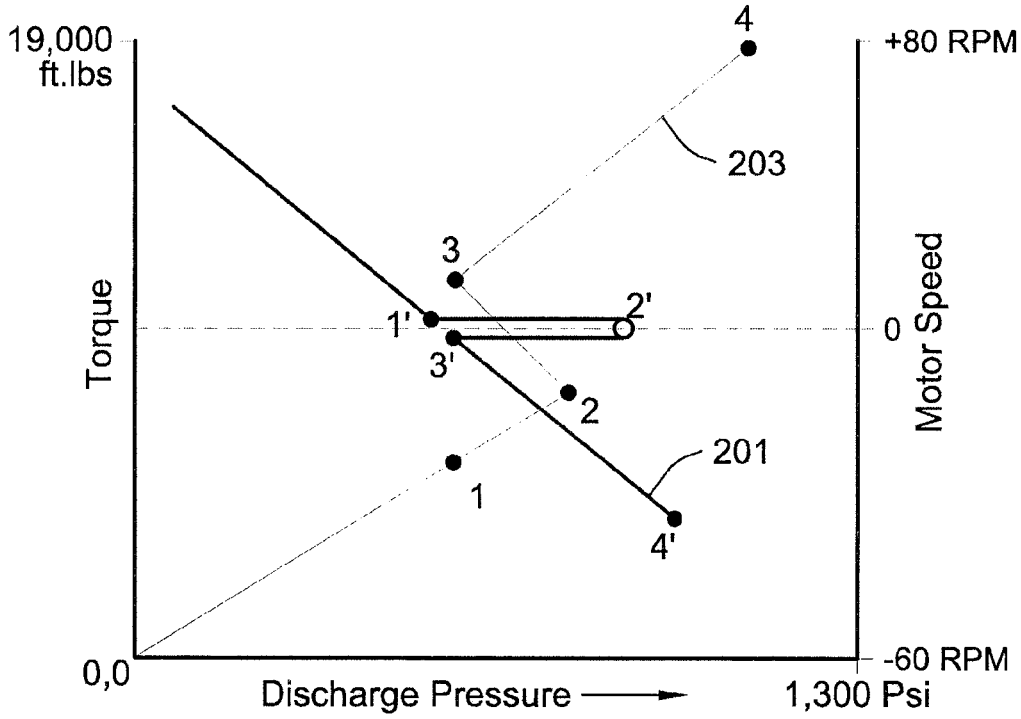
FIG. 5 is a graphical illustration of mud motor performance (e.g., stator RPM) versus discharge pressure in accordance with aspects of the present disclosure.

FIG. 5 is a graph of mud motor performance for a traditional drilling system, showing motor speed 201 (e.g., PDM rotor velocity in rotations per minute (RPM)) and torque 203 (e.g., PDM stator torque in foot-pounds (ft·lbs)) versus discharge pressure (in pounds per square inch (Psi)). The discharge pressure in the illustrated example is the pressure of the drilling fluid measured at the exit of the mud pump—e.g., a three-piston reciprocating piston "triplex" pump—which regulates downhole flow. In the embodiment of FIG. 5, the mud motor performance curve was conducted on a test beam using a top drive (e.g., a hydraulic or electric motor suspended in the drill rig derrick) to drive the drill string and a triplex pump to drive the mud motor. In accordance with this arrangement, the rotational speed of the drill bit is the summation of top drive speed and mud motor speed. Reference numerals 1, 2, 3 and 1', 2', 3' of FIG. 5 are indicators of time where like numbers—i.e., 1 and 1', 2 and 2', 3 and 3', denote the same moment in time.

During a stick/slip/stall event, which is indicated temporally in FIG. 5 at points 1 and 1', the motor speed comes to an instantaneous "zero" rpm, but the stator continues to spin and stator torque continues to increase in an attempt to overpower the rotor which is now stuck with the bit. This causes the mud motor to pump drilling fluid uphole, increasing the differential pressure, which is directly proportional to drill string and power train torque. Motor speed remains at zero from points 1' to 2' while the top drive continues to rotate the stator and stator torque continues to steadily increase in a "low slope" region from points 1 to 2. From point 2 to point 3, the stator torque continues to increase while discharge pressure temporarily subsides; nevertheless, motor speed remains zero from point 2' to point 3'. At point 3', the motor changes direction and, from points 4 to 4', gains "negative" speed (e.g., increases velocity in a counterclockwise direction). When the motor speed goes negative at point 3', the stator enters a "high slope" torque region from point 3 to point 4 where torque increases at a rate that is well beyond conventional operation. Consequently, the stator is rotating faster than the rotor, which is generally unacceptable or undesirable.

Figure 6:
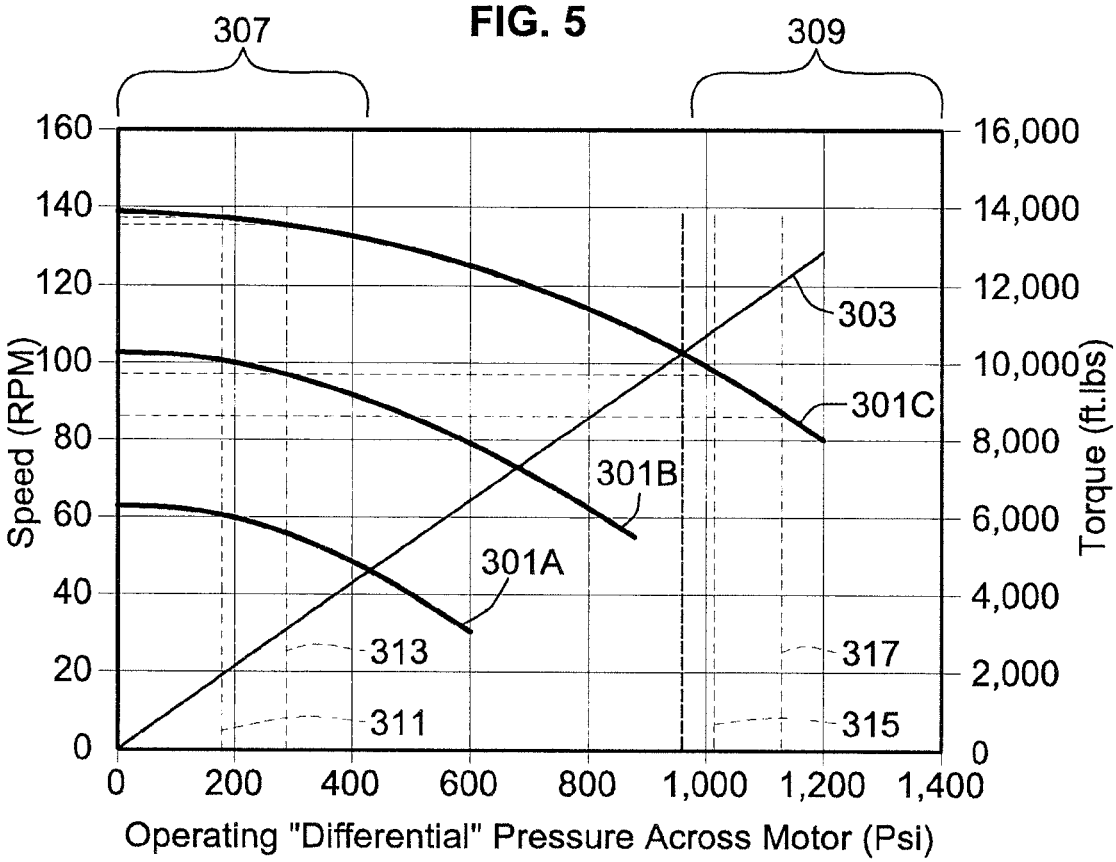
FIG. 6 is a graphical illustration of mud motor performance (e.g., stator RPM) versus operating differential pressure across the motor in accordance with aspects of the present disclosure.

Turning to FIG. 6, there is shown another graph of mud motor performance for a traditional drilling system, now presenting motor speed (e.g., PDM rotor velocity in rotations per minute (RPM)) and torque 303 (e.g., PDM stator torque in foot-pounds (ft·lbs)) versus operating differential pressure (Psi) across the motor. This graph shows three different motor speeds each at a respective fluid feed rate (in gallons per minute (GPM)): a first motor speed 301A at 300 GPM, a second motor speed 301B at 475 GPM, and a third motor speed 301C at 650 GPM. The operating differential in the illustrated example is the difference between pressure above (e.g., upstream) and below (e.g., downstream) the rotor. Lines 311 and 313 each show a variation in differential pressure when the mud motor is operating in a "recommended zone," which is generally designated as 307 in FIG. 6. By way of contrast, lines 315 and 317 each show a variation in differential pressure when the mud motor is operating in a "critical zone," which is generally designated as 309 in FIG. 6. When operating within the recommended zone 307, which is desired in at least some embodiments, variations in differential pressure equal a relatively small variation in motor speed. However, the same pressure variance in the critical zone 309 equates to a much larger variation in motor speed.

Aspects of this disclosure are directed to preventing the stator of an in-hole motor from exceeding the rotational speed of the rotor during stick/slip/stall events. By arresting the relative movement between the power train (e.g., the rotor) and the external housing and/or stator, the torque output to the bit can be enhanced to overcome the stick/stall friction between the bit and earth formation. This is achieved, in accordance with at least some aspects of the disclosed concepts, by locking the lowest-most housing portion of the drill string to the driveshaft of the motor. Optional embodiments can include locking any one or more of the housings connected to the stator to any shaft connected to the rotor. Other optional and alternative arrangements lock the stator directly to the rotor. In some of the disclosed embodiments, the bearing housing is locked to the drive shaft because the drive shaft is oftentimes the strongest component in the motor.

Figure 7:
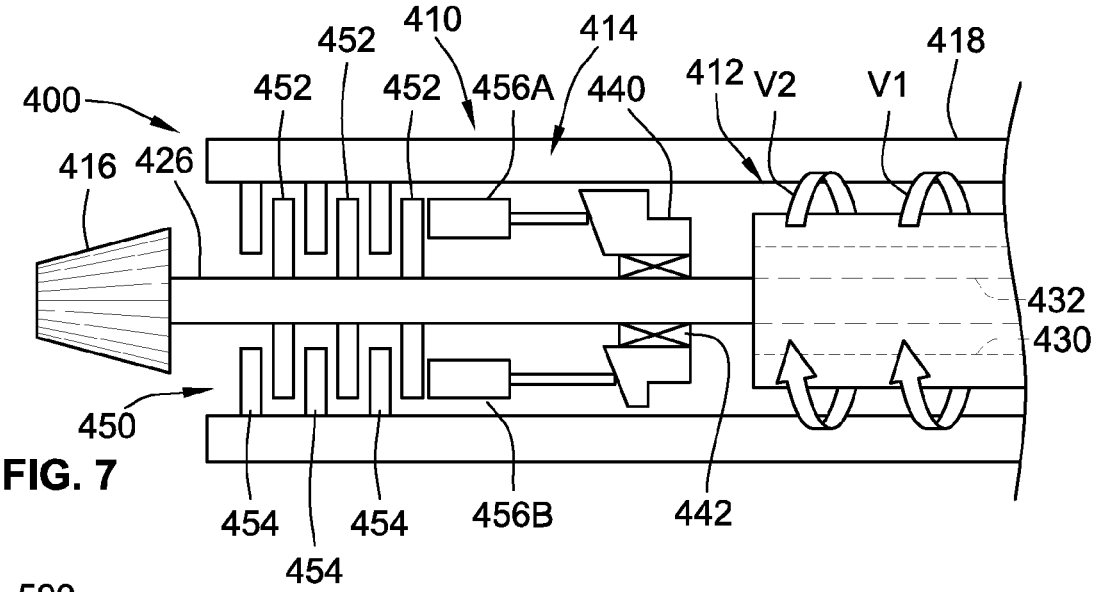
FIG. 7 is a schematic illustration of a representative motor assembly with a swash-plate actuated friction brake assembly in accordance with aspects of the present disclosure.

With reference to FIG. 7, there is shown a portion of a drill string system 400 of the type used for drilling a borehole in an earth formation. The drill string system 400 is represented by a motor assembly 410 with an internally packaged prime mover 412 and a rotational locking assembly 414. The drill string system 400 of FIG. 7 can take on any of the various forms, optional configurations, and functional alternatives described above with respect to the arrangements shown in FIGS. 1-3, and thus can include any of the corresponding options and features. Like the systems shown in FIGS. 1-3, only selected components of the drill string system 400 of FIG. 7 have been shown and will be developed further herein. Nevertheless, the drill string system 400 can include numerous additional, alternative, and other well-known peripheral components without departing from the scope and spirit of the present disclosure.

The motor assembly 410 of FIG. 7 includes a rotatable drill bit 416 that is located at a distal end of the drill string 400, projecting from an elongated, tubular motor housing 418. The motor housing 418 is configured to couple to a drill pipe (e.g., drill pipe section 24 of FIG. 1) in the drill string 400 such that the drill pipe can transmit rotational drive forces and, in some embodiments, pressurized drilling fluid (e.g., mud 31 of FIG. 1) to the motor housing 418. Although shown and described as a positive displacement motor (PDM) assembly, the prime mover 412 in FIG. 7 can also take on alternative in-hole motor configurations, such as turbine motors and electric motors, for example. A stator, which is shown schematically with hidden lines at 430, is disposed within the motor housing 418 and rotates at a stator speed V1. Within the internal passage of the stator 430 is a rotor, shown schematically in FIG. 7 with hidden lines 432, which is coupled to the drill bit 416 and configured to rotate at a rotor speed V2. A drive shaft 426 mechanically couples the rotor 432 to the drill bit 416 and thereby transmits rotational drive forces generated by the prime mover 412 to the drill bit 416. The rotational locking assembly 414 is disposed between and operatively coupled to the motor housing 418 and the rotor 432 (e.g., the drive shaft 426 mechanically couples the rotor 432 to the rotational locking assembly 414).

Rotational locking assembly 414 of FIG. 7 is configured to prevent the stator speed V1 of the stator 430 from exceeding the rotor speed V2 of the rotor 432. In the embodiment illustrated in FIG. 7, the rotational locking assembly 414 is a swash-plate actuated friction brake assembly that is configured to selectively lock the driveshaft 426 and, thus, the rotor 432 to the motor housing 418. A swash plate 440 is disposed within the motor housing 418 of FIG. 7. One-way coupling device 442, which may be a one-way clutch or similar device, rotatably mounts the swash plate 440 onto the drive shaft 426 or, in alternative configurations, to another component within the housing 418. The friction brake assembly includes a clutch pack 450 comprising a plurality of friction plates 452 interleaved with a plurality of reaction plates 454. As shown, the friction plates 452 are coupled to the rotor 432 (e.g., via splined or welded engagement with the drive shaft 426), whereas the reaction plates 454 are coupled (e.g., splined or welded) to the motor housing 418. Optionally, the reaction plates 454 can be coupled to the rotor 432 and the friction plates 452 can be coupled to the motor housing 418.

The swash plate 440 is configured to selectively compress the clutch pack 450 and thereby lock the drive shaft 426 and rotor 432 to the housing 418. By way of explanation, and not limitation, the friction brake assembly 414 further comprises one or more pistons 456A and 456B disposed between and operatively connecting the swash plate 440 to the clutch pack 450. Angled rotation of the swash plate 440 operates to engage and thereby actuate one or more of the pistons 456A, 456B such that the piston(s) 456A, 456B press the friction plates 452 together with the reaction plates 454. For instance, during a stick/slip/stall event, the external housing 418 will attempt to overcome the power train speed and overpower the rotor. This causes the swash plate arrangement 440 to rotate on the one-way coupling device 442 which, in turn, will energize or otherwise activate the hydraulic piston(s) 456A, 456B through the "swash plate effect." The energized piston(s) 456A, 456B will push against the clutch pack 450 arresting any relative/reverse motion between the rotor 432 and housing 418. Selectively locking the drive shaft 426 and rotor 432 to the motor housing 418 in this manner allows torsional forces to be transferred from the drill bit 416 through the drive shaft 426 and rotational locking assembly 414 to the motor housing 418.

Figure 8:
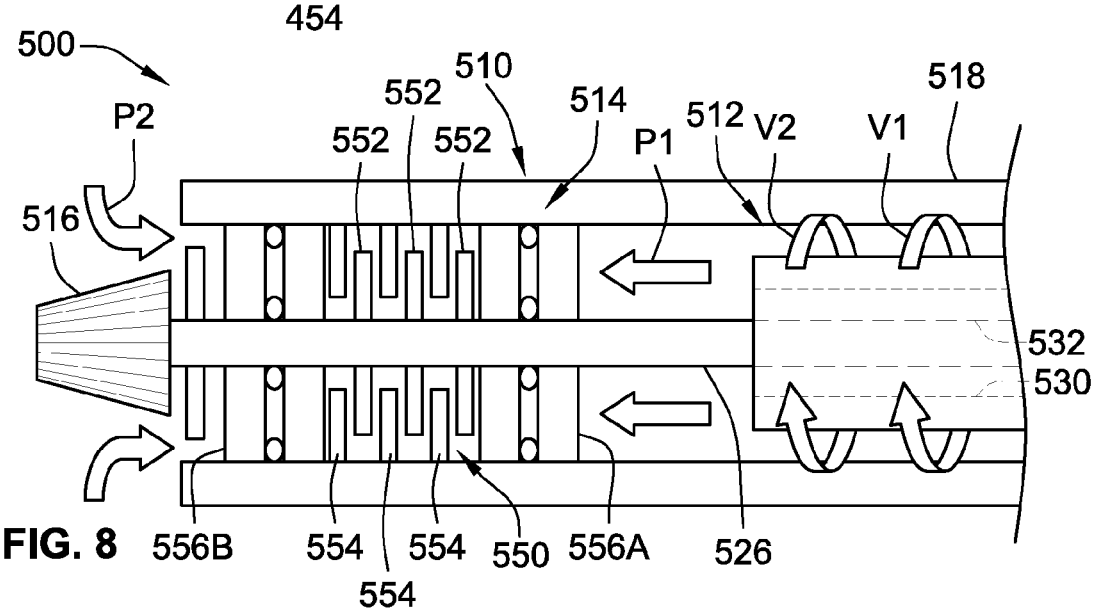
FIG. 8 is a schematic illustration of a representative motor assembly with a differential-pressure lockup assembly in accordance with aspects of the present disclosure.

FIG. 8 illustrates a portion of another drill string system 500 of the type used for drilling a borehole in an earth formation. Similar to the exemplary configuration set forth in FIG. 7, the drill string system 500 of FIG. 8 is represented by a motor assembly 510 with an internally packaged prime mover 512 and a rotational locking assembly 514. The drill string system 500 of FIG. 8 can take on any of the various forms, optional configurations, and functional alternatives described above with respect to the arrangements shown in FIGS. 1-3 and 7, and thus can include any of the corresponding options and features. Furthermore, only selected components of the drill string system 500 of FIG. 8 have been shown and will be developed further herein. Nevertheless, the drill string system 500 can include numerous additional, alternative, and other well-known peripheral components without departing from the intended scope and spirit of the present disclosure.

A rotatable drill bit 516 is located at a distal end of the drill string 500, projecting from an elongated, tubular motor housing 518. The motor housing 518 is configured to couple to a drill pipe (e.g., drill pipe section 24 of FIG. 1) in the drill string 500 such that the drill pipe can transmit rotational drive forces and, in some embodiments, pressurized drilling fluid (e.g., mud 31 of FIG. 1) to the motor housing 518. The prime mover 512 of FIG. 8 is a positive displacement motor (PDM) assembly; nevertheless, the prime mover 512 can take on alternative in-hole motor configurations, such as, for example, turbine motors and electric motors. A stator, which is shown schematically in FIG. 8 with hidden lines at 530, is disposed within the motor housing 518 and rotates at a stator speed V1. Within the internal passage of the stator 530 is a rotor, shown schematically with hidden lines 532, which is coupled to the drill bit 516 and configured to rotate at a rotor speed V2. A drive shaft 526 mechanically couples the rotor 532 to the drill bit 516 and thereby transmits rotational drive forces generated by the prime mover 512 to the bit 516. The rotational locking assembly 514 is disposed between and operatively coupled to the motor housing 518 and the rotor 532.

Like the rotational locking assembly 414 featured in FIG. 7, the rotational locking assembly 514 of FIG. 8 is configured to prevent the speed V1 of the stator 530 from exceeding the speed V2 of the rotor 532. According to the illustrated example of FIG. 8, the rotational locking assembly 514 is a differential-pressure lockup assembly that is configured to selectively lock the driveshaft 526 and, thus, the rotor 532 to the housing 518 in response to a threshold difference in fluid pressure across the differential-pressure lockup assembly. The differential-pressure lockup assembly includes a clutch pack 550 comprising a plurality of friction plates 552 interleaved with a plurality of reaction plates 554. As shown, the friction plates 552 are coupled to the rotor 532, e.g., via splined or welded engagement with the drive shaft 526. The reaction plates 554, on the other hand, are coupled (e.g., splined or welded) to the motor housing 518. Some optional arrangements may include the reaction plates 554 being coupled to the rotor 532 and the friction plates 552 being coupled to the motor housing 518.

The differential-pressure lockup assembly further comprises at least one and, in the illustrated embodiment, a pair of pistons, namely first and second floating pistons 556A and 556B, respectively, each of which is disposed on a respective opposing side of the clutch pack 550. When the fluid pressure across the differential-pressure lockup assembly meets or exceeds a predetermined threshold difference, the pressure differential causes the floating pistons 556A, 556B to translate towards each other. By this means, the opposing floating pistons 556A, 556B operate to compress the friction plates 552 against the reaction plates 554. By way of non-limiting example, the first floating piston 556A is exposed to and acted against by drill-pipe pressure P1. The second floating piston 556B, in contrast, is exposed to and acted against by annulus pressure P2. During a stall event, the external housing 518 will try to overcome the power train speed causing a large spike in differential pressure. The pressure differential, in turn, energizes or otherwise activates the floating pistons 556A, 556B, drawing them towards one another. The energized pistons 556A, 556B will push against the clutch pack arrangement 550 arresting the relative/reverse motion between the rotor 532 and housing 518. This arrangement, like the arrangement presented in FIG. 7, provides for a gradual lockup of the powertrain components.

Figure 9:
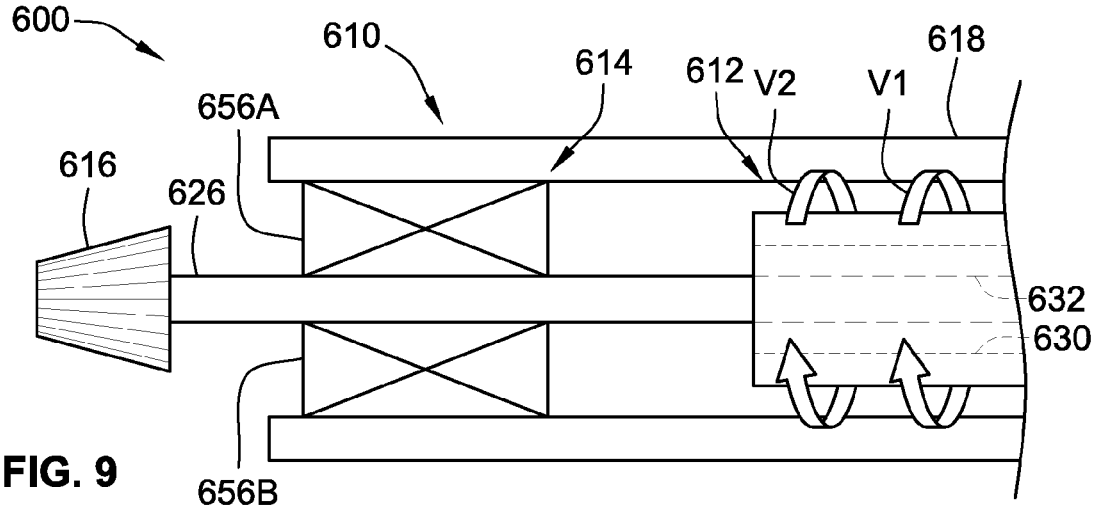
FIG. 9 is a schematic illustration of a representative motor assembly with a one-way overrunning coupler assembly in accordance with aspects of the present disclosure.

With reference now to FIG. 9, there is shown a portion of yet another drill string system 500 of the type used for drilling a borehole in an earth formation. Similar to the exemplary configurations set forth in FIGS. 7 and 8, the drill string system 600 of FIG. 9 is represented by a motor assembly 610 with an internally packaged prime mover 612 and a rotational locking assembly 614. Unless otherwise explicitly prohibited, the drill string system 600 of FIG. 9 can take on any of the various forms, optional configurations, and functional alternatives described above with respect to the other illustrated configurations, and thus can include any of the corresponding options and features. Furthermore, only selected components of the drill string system 600 have been shown and will be developed further herein. Nevertheless, the drill string system 500 can include additional, alternative, and other well-known peripheral components without departing from the scope and spirit of the present disclosure.

A rotatable drill bit 616 is located at a distal end of the drill string 600, projecting from an elongated, tubular motor housing 618. The motor housing 618 is configured to couple to a drill pipe (e.g., drill pipe section 24 of FIG. 1) in the drill string 600 such that the drill pipe can transmit rotational drive forces and, in some embodiments, pressurized drilling fluid (e.g., mud 31 of FIG. 1) to the motor housing 618. The prime mover 612 of FIG. 9 is depicted and described as a positive displacement motor (PDM) assembly. The prime mover 612, however, can take on alternative in-hole motor configurations, such as, for example, turbine motors and electric motors. A stator 630 is shown schematically in FIG. 9 disposed within the motor housing 618 and rotating at a stator speed V1. Within the internal passage of the stator 630 is a rotor 632, which is coupled to the drill bit 616 and configured to rotate at a rotor speed V2. A drive shaft 626 mechanically couples the rotor 632 to the drill bit 616 to transmit rotational drive forces generated by the prime mover 612 to the bit 616. The rotational locking assembly 614 is disposed between and operatively coupled to the motor housing 618 and the rotor 632.

The rotational locking assembly 614 of FIG. 9 is configured to prevent the stator speed V1 from exceeding the rotor speed V2, for example, during a stick/slip/stall event. In the illustrated embodiment, the rotational locking assembly 614 is a one-way overrunning coupler assembly configured to lock the driveshaft 626 and, thus, the rotor 632 to the housing 618 when the stator speed V1 of the stator 630 exceeds the rotor speed V2 of the rotor 632. In some non-limiting examples, the one-way overrunning coupler assembly 614 may be a one-way sprag clutch, an overrunning clutch, a dog clutch, a centrifugal clutch, etc. The one-way overrunning coupler assembly 614 includes a plurality of locking elements, shown schematically at 656A and 656B in FIG. 9, disposed between and operatively connected to the housing 618 and the drive shaft 626. The locking elements 656A, 656B, which may be rollers, sprags, pawls, balls, etc., are cooperatively configured to lock the drive shaft 626 and, thus, the rotor 632 to the motor housing 618. In some embodiments, the one-way overrunning coupler assembly 614, (e.g., an outer race) is at least partially integrally formed with the housing 618. In a similar regard, the one-way overrunning coupler assembly 614, (e.g., an inner race) may be at least partially integrally formed with the drive shaft 626 or rotor 632. This arrangement will arrest any relative/reverse motion between the rotor 632 and housing 618 when the stator speed V1 exceeds the rotor speed V2. This will allow torque from the top drive to be transferred to the bit 616 via the housing 618 to overcome the static stall friction between the bit and formation.

Through the introduction of the disclosed locking devices, the power train components can be protected from a torque spike event and also provide extra boost to overcome static stall friction. By arresting the relative/reverse motion between the powertrain and outer housing during a stick/slip/stall event, the system can prevent an instantaneous buildup of differential pressure that exceeds a power section stall condition. In so doing, the power train/torque members can be protected from sudden spikes of stall torque. Moreover, by arresting the power train to the external housing, the stall torque can be transferred from the bit to the external housing, which has the capability of handling much higher torques than the power train. Protecting the BHA string from sudden torque spikes will reduce down time and repair costs and, thus, increase ROP and drilling time.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A fluid-driven motor assembly for use in a drill string to drill a borehole in an earth formation, the drill string having a drill pipe and a drill bit, the motor assembly comprising:

a housing configured to operatively connect to the drill pipe of the drill string to receive drilling fluid therefrom;

a stator disposed within the housing and defining an internal passage, the stator being configured to rotate at a stator speed;

a rotor disposed within the internal passage of the stator and coupled to the drill bit through a drive shaft, the rotor being configured to rotate at a rotor speed; and a rotational locking assembly coupled between the drive shaft and the housing, the rotational locking assembly being configured to selectively lock the drive shaft to the housing to prevent the stator speed of the stator from exceeding the rotor speed of the rotor.

2. The motor assembly of claim 1, wherein the rotational locking assembly is configured to selectively lock the rotor to the housing.

3. The motor assembly of claim 1, further comprising a swash plate disposed within the housing, wherein the rotational locking assembly includes a swash-plate actuated friction brake assembly configured to selectively lock the rotor to the housing.

4. The motor assembly of claim 3, wherein the friction brake assembly includes a clutch pack comprising a plurality of friction plates interleaved with a plurality of reaction plates, the friction plates being coupled to one of the rotor and the housing, and the reaction plates being coupled to the other of the rotor and the housing, wherein the swash plate is configured to selectively compress the clutch pack.

5. The motor assembly of claim 4, wherein the friction brake assembly further comprises one or more pistons operatively connecting the swash plate to the clutch pack, wherein rotation of the swash plate actuates the one or more pistons whereby the one or more pistons press the friction plates together with the reaction plates.

6. The motor assembly of claim 5, further comprising a one-way coupling device rotatably mounting the swash plate in the housing.

7. The motor assembly of claim 1, wherein the rotational locking assembly includes a differential-pressure lockup assembly configured to selectively lock the rotor to the housing in response to a threshold difference in fluid pressure across the differential-pressure lockup assembly.

8. The motor assembly of claim 7, wherein the differential-pressure lockup assembly includes a clutch pack comprising a plurality of friction plates interleaved with a plurality of reaction plates, the friction plates being coupled to one of the rotor and the housing, and the reaction plates being coupled to the other of the rotor and the housing.

9. The motor assembly of claim 8, wherein the differential-pressure lockup assembly further comprises first and second floating pistons disposed on opposing sides of the clutch pack, the threshold difference in fluid pressure causing the first and second floating pistons to translate towards each other.

10. The motor assembly of claim 9, wherein the first floating piston is exposed to drill-pipe pressure and the second floating piston is exposed to annulus pressure.

11. The motor assembly of claim 1, wherein the rotational locking assembly includes a one-way overrunning coupler assembly configured to lock the rotor to the housing when the stator speed of the stator exceeds the rotor speed of the rotor.

12. The motor assembly of claim 11, wherein the one-way overrunning coupler assembly includes a plurality of locking elements cooperatively configured to lock the rotor to the housing.

13. The motor assembly of claim 11, wherein the one-way overrunning coupler assembly is at least partially integrally formed with the housing.

14. A drilling motor assembly for use in a drill string to drill a borehole in an earth formation, the drill string having a drill pipe and a drill bit, the motor assembly comprising:

a motor housing configured to mechanically couple to the drill pipe in the drill string such that the drill pipe transmits rotational drive forces to the motor housing;

a prime mover disposed within the motor housing;

a drive shaft configured to transmit rotational drive forces generated by the prime mover to the drill bit;

a rotational locking assembly coupled between the drive shaft and the motor housing, the rotational locking assembly being configured to selectively lock the drive shaft to the motor housing such that torque is transferred back from the drill bit through the drive shaft and the rotational locking assembly to the motor housing.

15. The drilling motor assembly of claim 14, wherein the prime mover is one of a positive displacement motor, a turbine motor, and an electric motor.

16. A drill string assembly comprising:

a drill-pipe string;

a motor housing mechanically and fluidly coupled to a distal end of the drill-pipe string such that the drill-pipe string transmits rotational drive forces and drilling fluid to the motor housing;

a drill bit coupled at a distal end of the motor housing;

a fluid-driven motor assembly at least partially disposed within the motor housing, the motor assembly including a rotor rotatable within a stator, the rotor being coupled to the drill bit through a drive shaft, the stator being rotated at a stator speed, at least in part, via the rotational drive forces from the drill-pipe string, and the rotor being rotated at a rotor speed, at least in part, via the passing of drilling fluid through the fluid-driven motor assembly; and a rotational locking assembly coupled between the drive shaft and the motor housing, the rotational locking assembly being configured to selectively lock the drive shaft to the motor housing and thereby prevent the stator speed of the stator from exceeding the rotor speed of the rotor.

17. The drill string assembly of claim 16, further comprising a swash plate disposed within the motor housing, wherein the rotational locking assembly includes a swash-plate actuated friction brake assembly configured to selectively lock the rotor to the housing.

18. The drill string assembly of claim 16, wherein the rotational locking assembly includes a differential-pressure lockup assembly configured to selectively lock the rotor to the housing in response to a threshold difference in fluid pressure across the differential-pressure lockup assembly.

19. The drill string assembly of claim 16, wherein the rotational locking assembly includes a one-way overrunning coupler assembly configured to lock the rotor to the housing when the stator speed of the stator exceeds the rotor speed of the rotor.

* * * * *